US009407037B2

(12) United States Patent
Kim et al.

(10) Patent No.: US 9,407,037 B2
(45) Date of Patent: Aug. 2, 2016

(54) CONNECTOR FOR VEHICLE

(71) Applicant: Kyungshin Co., Ltd., Incheon (KR)

(72) Inventors: Seung Rai Kim, Seongnam-si (KR); Jai Hyung Kim, Incheon (KR)

(73) Assignee: Kyungshin Co., Ltd., Incheon (KR)

( * ) Notice: Subject to any disclaimer, the term of this patent is extended or adjusted under 35 U.S.C. 154(b) by 0 days.

(21) Appl. No.: 14/477,423

(22) Filed: Sep. 4, 2014

(65) Prior Publication Data

US 2015/0295352 A1 Oct. 15, 2015

(30) Foreign Application Priority Data

Apr. 9, 2014 (KR) ..... 10-2014-0042516

(51) Int. Cl.
*H01R 12/00* (2006.01)
*H01R 13/629* (2006.01)

(52) U.S. Cl.
CPC .... *H01R 13/62938* (2013.01); *H01R 13/62955* (2013.01); *H01R 2201/26* (2013.01)

(58) Field of Classification Search
CPC ..... H01R 13/62922; H01R 13/62938; H01R 13/62955; H01R 13/62933; H01R 13/62905; H01R 23/7005
USPC ..... 439/157, 153, 352
See application file for complete search history.

(56) References Cited

U.S. PATENT DOCUMENTS 5,509,816 A * 4/1996 Katsuma ..... H01R 13/62938 439/153
6,217,354 B1 * 4/2001 Fencl ..... H01R 13/62977 439/157
6,682,359 B1 * 1/2004 Hitchcock ..... H01R 13/62944 439/153
7,267,564 B2 * 9/2007 Bauman ..... H01R 13/62955 439/157
7,361,036 B2 * 4/2008 Pittenger ..... H01R 13/62955 439/157
7,559,778 B2 * 7/2009 Pittenger ..... H01R 13/62955 439/157
8,057,245 B2 * 11/2011 Sakamaki ..... H01R 13/62933 439/157
8,215,979 B2 * 7/2012 Shamoto ..... H01R 13/62938 439/372
8,414,315 B2 * 4/2013 Dekoski ..... H01R 13/62938 439/157
9,203,186 B2 * 12/2015 Shishikura ..... H01R 13/62977
2003/0003787 A1 * 1/2003 Bakker ..... H01R 13/4538 439/157
2004/0192090 A1 * 9/2004 Flowers ..... H01R 13/5812 439/157

(Continued)

FOREIGN PATENT DOCUMENTS

JP 09213413 8/1997
KR 20-0264075 2/2002

*Primary Examiner* — Tulsidas C Patel
*Assistant Examiner* — Peter G Leigh
(74) *Attorney, Agent, or Firm* — Cesari and McKenna LLP

(57) ABSTRACT

Disclosed herein is a connector for vehicles, which allows easy disconnection between a male housing and a female housing. The connector includes a male housing, a female housing detachably connected to the male housing, a connection lever rotatably mounted on the female housing so as to be latched to the male housing, the connection lever connecting or disconnecting the male housing to or from the female housing through rotation, and a connector location assurance unit provided to the female housing so as to selectively interrupt rotation of the connection lever.

7 Claims, 9 Drawing Sheets

(56) References Cited

U.S. PATENT DOCUMENTS

2006/0234535 A1* 10/2006 Ohtaka ..... H01R 13/6272 439/157
2007/0020978 A1* 1/2007 Murakami ..... H01R 13/6295 439/157
2009/0203240 A1* 8/2009 Matsumura ..... H01R 13/62938 439/153
2011/0014805 A1* 1/2011 Sakamaki ..... H01R 13/62955 439/153
2011/0034049 A1* 2/2011 Shishikura ..... H01R 13/62944 439/157
2011/0086529 A1* 4/2011 Kobayashi ..... H01R 13/62966 439/157
2013/0059457 A1* 3/2013 Hori ..... H01R 13/62933 439/270
2013/0126205 A1* 5/2013 Henmi ..... H01H 35/003 174/53
2013/0224974 A1* 8/2013 Furuya ..... H01R 24/005 439/153
2013/0237078 A1* 9/2013 Ikeda ..... H04H 9/102 439/157
2013/0323954 A1* 12/2013 Eckel ..... H01R 13/5219 439/271
2014/0199876 A1* 7/2014 Kato ..... H01R 13/4538 439/352
2014/0206213 A1* 7/2014 Kato ..... H01R 13/533 439/157
2014/0273565 A1* 9/2014 Papurcu ..... H01R 13/533 439/153
2014/0377970 A1* 12/2014 Crovetti ..... H01R 13/5213 439/131

* cited by examiner

CONNECTOR FOR VEHICLE

CROSS REFERENCE TO RELATED APPLICATIONS

This application claims the benefit of Korean Application No. 10-2014-0042516, filed on Apr. 9, 2014. The content of this application is hereby incorporated by reference in its entirety.

BACKGROUND

1. Technical Field

The present invention relates to a connector for vehicles, and more particularly, to a connector for vehicles, which allows easy disconnection between a male housing and a female housing.

2. Description of the Related Art

As fossil energy is gradually exhausted and environmental concern increases, hybrid vehicles and electric vehicles are attracting public attention worldwide.

Since the hybrid vehicle or the electric vehicle uses higher voltage/higher current than typical vehicles, an electric device for stably supplying and distributing external power to internal components of the vehicle is required. In addition, the hybrid vehicle or the electric vehicle also requires modularized units for electronic control of the vehicle, and use of connector-attached electric wires or communication cables for transmission of electric signals is rapidly increasing.

Such a connector is used for electrical connection between vehicle components and is subjected to various safety tests to prevent electric error when mounted on the vehicle components.

A typical connector is provided with a pair of male and female housings, which are connected to and disconnected from each other, and a connector location assurance (CPA) member, which serves to prevent the connected housings from being disconnected from each other. The CPA member is connected to an unlocking button to prevent the unlocking button from being pressed when the male housing is connected to the female housing, and is disconnected from the unlocking button when the male housing is disconnected from the female housing.

However, the typical connector has a problem in that, since the male housing and the female housing are disconnected from each other by sliding the CPA member and then pressing the unlocking button, it is difficult to manipulate and secure the CPA member and the unlocking button. Moreover, since the CPA member is inserted into the unlocking button, it is difficult to manipulate the CPA member. Therefore, there is a need for a connector for vehicles overcoming such problems in the art.

DOCUMENTS OF THE RELATED ART

Patent Document 1: Korean Utility Patent No. 20-0264075 (entitled "Assembly Structure of Connector for Vehicle" and registered on Jan. 30, 2002)

BRIEF SUMMARY

Therefore, the present invention has been conceived to solve the problems in the related art and it is one aspect of the present invention to provide a connector for vehicles, which can reduce an operating space for connection between male and female housings and allows easy disconnection between the male and female housings from each other.

In accordance with one aspect of the present invention, a connector for vehicles includes: a male housing; a female housing detachably connected to the male housing; a connection lever rotatably mounted on the female housing so as to be latched to the male housing, the connection lever connecting or disconnecting the male housing to or from the female housing through rotation; and a connector location assurance unit provided to the female housing so as to selectively interrupt rotation of the connection lever.

The connection lever may include: a body hingedly coupled to the female housing; a guide portion formed on the body so as to selectively come into contact with the male housing in response to rotation of the body, and guiding the male housing to be moved such that the male housing is connected to or disconnected from the female housing; and a latch portion provided to the body so as to secure the body to the connector location assurance unit when the male housing and the female housing are connected to each other.

The male housing may include a coupling protrusion coupled to the connection lever and the female housing may include a sliding groove to guide the coupling protrusion to be linearly moved along the sliding groove.

The male housing may include a coupling protrusion inserted into the guide portion and the guide portion may be formed in a groove shape such that the coupling protrusion is inserted into the groove and guided thereby.

The connector location assurance unit may include: a lever latch portion provided to the male housing such that the connection lever is latched to the lever latch portion when the male housing and the female housing are connected to each other; and a lever release portion movably provided to the lever latch portion and selectively releasing the connection lever from the lever latch portion.

The connector location assurance unit may further include a separation preventing portion preventing separation of the lever release portion from the lever latch portion.

The lever latch portion may include: a mounting plate to which the lever release portion is movably coupled; and a latch hole formed in the mounting plate such that the connection lever and the lever release portion are inserted into and connected to the latch hole.

The lever release portion may be maintained in a movable state from the lever latch portion by contact with the connection lever when the connection lever is latched to the lever latch portion.

The lever release portion may be moved from the lever latch portion and separated from the connection lever, when maintained in a movable state by contact with the connection lever.

The lever release portion may release the connection lever when brought into contact with the connection lever latched to the lever latch portion and subjected to pressure.

BRIEF DESCRIPTION OF THE DRAWINGS

The above and other aspects, features and advantages of the present disclosure will become apparent from the following description of embodiments given in conjunction with the accompanying drawings, in which.

DETAILED DESCRIPTION

Hereinafter, embodiments of the present invention will be described in detail with reference to the accompanying drawings. It should be noted that the drawings are not to precise scale and may be exaggerated in thickness of lines or size of components for descriptive convenience and clarity only. Further, the terms used herein are defined by taking functions of the present invention into account and can be changed according to user or operator custom or intention. Therefore, definition of the terms should be made according to the overall disclosure set forth herein.

Figure 1:
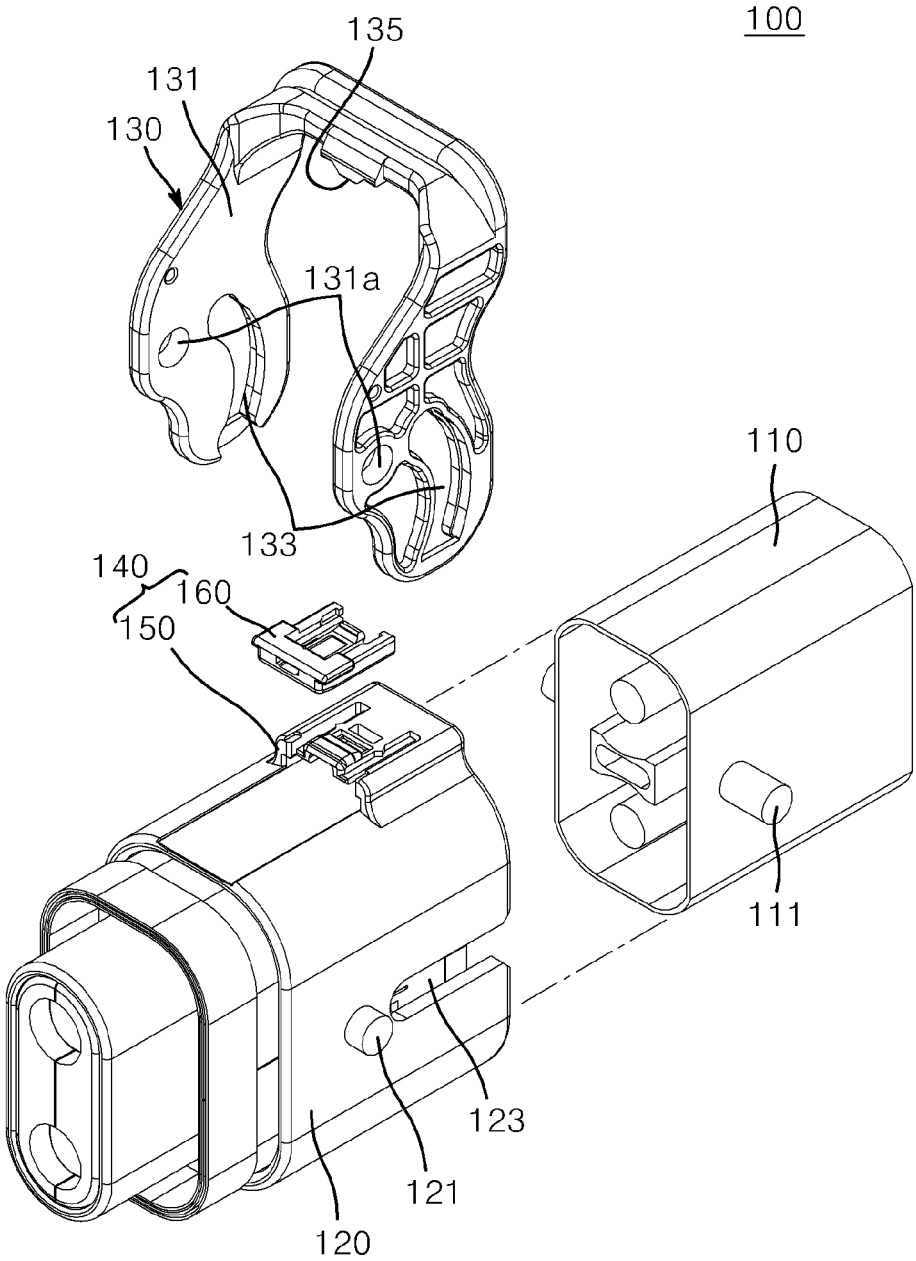
FIG. 1 is an exploded perspective view of a connector for vehicles according to one embodiment of the present invention.
Figure 2:
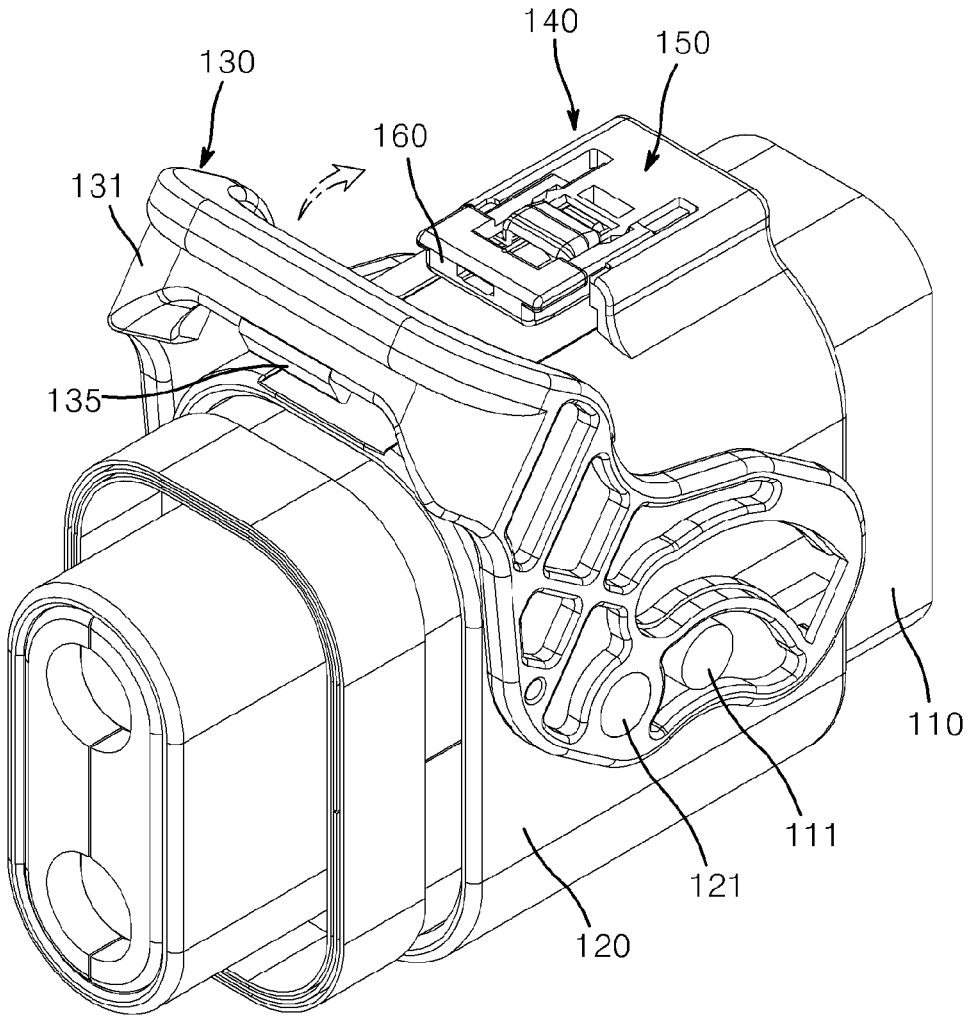
FIG. 2 is a perspective view of a male housing and a female housing connected to each other in the connector for vehicles according to the embodiment of the present invention.
Figure 3:
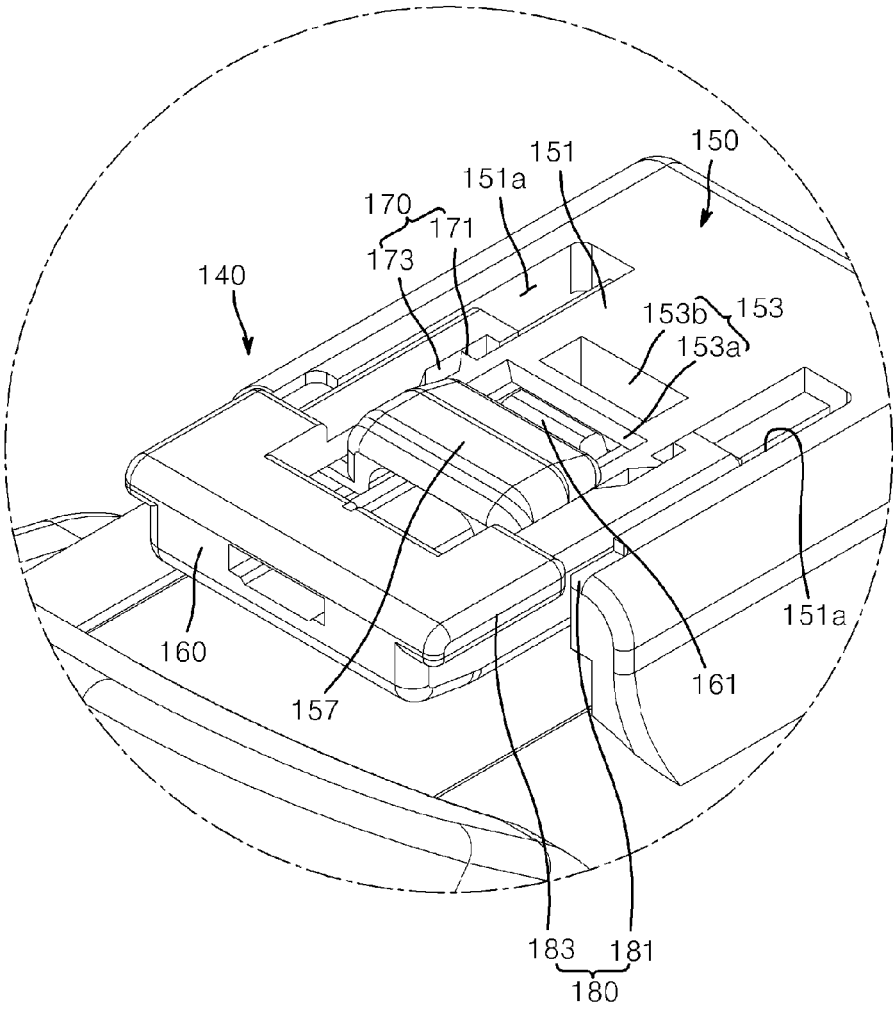
FIG. 3 is an enlarged perspective view of major components of FIG. 2.

FIG. 1 is an exploded perspective view of a connector for vehicles according to one embodiment of the present invention, FIG. 2 is a perspective view of a male housing and a female housing connected to each other in the connector for vehicles according to the embodiment of the present invention, and FIG. 3 is an enlarged perspective view of major components of FIG. 2.

Figure 4:
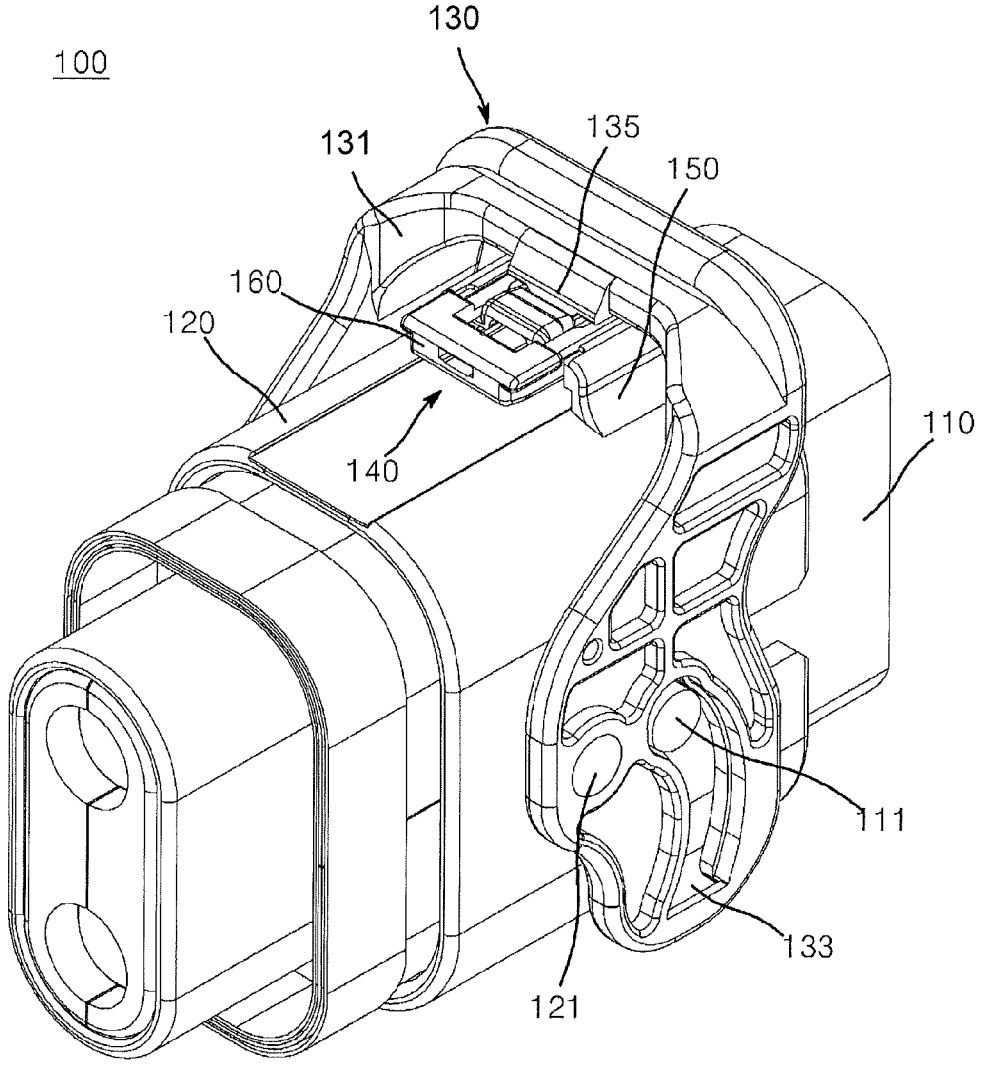
FIG. 4 is a perspective view of the male housing and the female housing in a secured state by a connection lever in the connector for vehicles according to the embodiment of the present invention.
Figure 5:
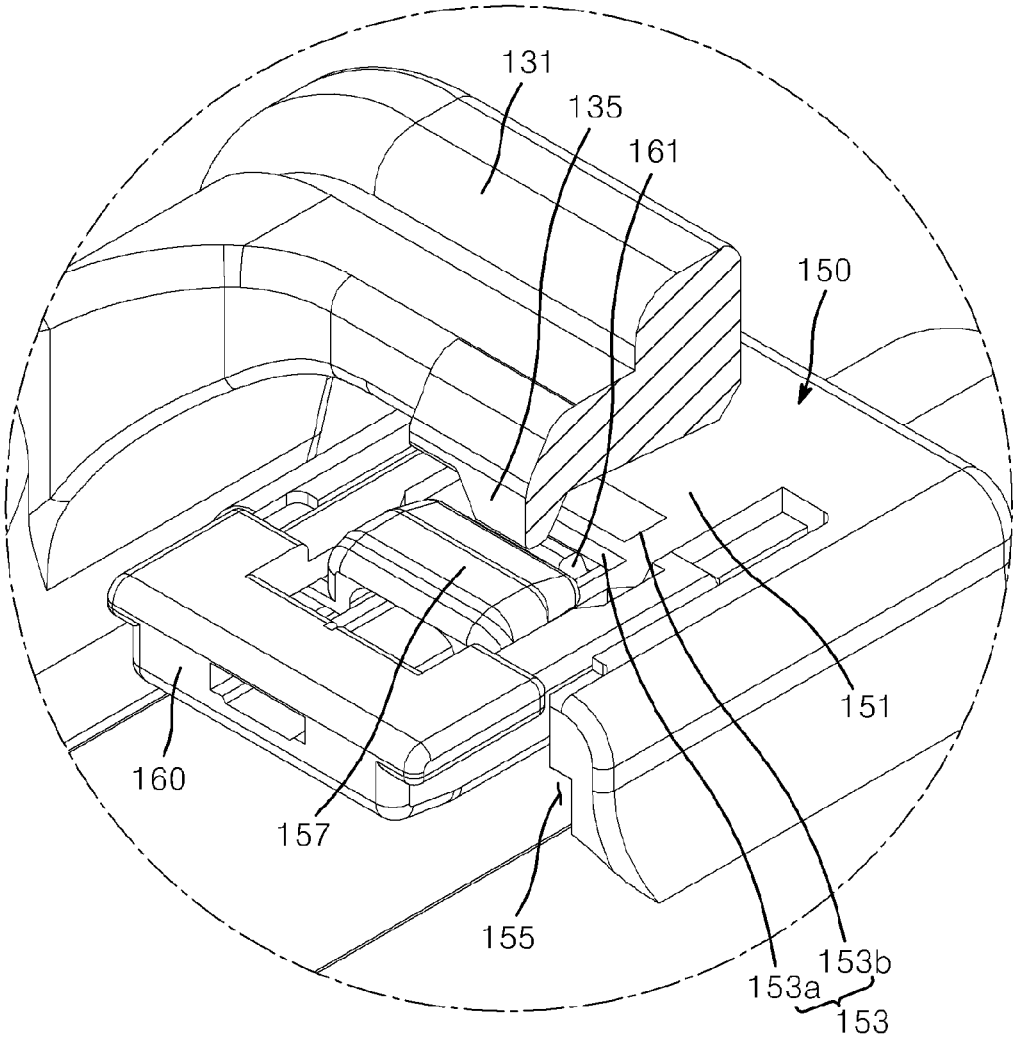
FIG. 5 is an enlarged perspective view of major components of FIG. 4.

FIG. 4 is a perspective view of the male housing and the female housing in a secured state by a connection lever in the connector for vehicles according to the embodiment of the present invention and FIG. 5 is an enlarged perspective view of major components of FIG. 4.

Referring to FIGS. 1 to 5, in a connector for vehicles 100 according to one embodiment of the invention, a male housing 110 and a female housing 120 may be connected to or disconnected from each other using a connection lever 130, and a connected state between the male and female housings 110, 120 may be stably maintained using a connector location assurance (CPA) unit 140. Here, connection and disconnection between the male and female housings 110 and 120 may be easily performed through rotation of the connection lever 130.

The male housing 110 is formed on an outer surface thereof with coupling protrusions 111, which are coupled to the connection lever 130 for connection with and disconnection from the female housing 120. The male housing 110 is inserted into and connected to the female housing 120 by rotation of the connection lever 130.

The female housing 120 is provided with hinge-protrusions 121 to which the connection lever 130 is rotatably coupled, and sliding grooves 123 along which the male housing 110 is stably linearly guided for connection with the female housing. The coupling protrusions 111 of the male housing 110 are inserted into the sliding grooves 123 such that the coupling protrusions 111 are exposed from the female housing 120. In this state, the coupling protrusions 111 slide along the sliding grooves. This configuration allows the coupling protrusions 111 to be latched to the connection lever 130 even in a state of being inserted into the sliding grooves 123.

The female housing 120 is provided with a connector location assurance (CPA) unit 140 in order to allow the connection lever 130 to be coupled thereto and to selectively interrupt rotation of the connection lever 130.

The connection lever 130 is rotatably coupled to the hinge-protrusions 121 of the female housing 120, and serves to connect or disconnect the male housing 110 with or from the female housing 120 through rotation in the female housing 120. When the male housing 110 is completely connected to the female housing 120 by rotation of the connection lever 130, the connection lever 130 is prevented from rotating by the CPA unit 140.

The connection lever 130 includes a body 131 rotatably coupled to the hinge-protrusions 121 of the female housing 120, guide portions 133 which guide the coupling protrusions 111 so as to move the male housing 110, and a latch portion 135 which secures the body 131 to the location assurance unit 140.

The body 131 has a rectangular shape open at one side thereof, for example, a "ㄷ" shape, and is provided at both ends thereof with hinge holes 131*a* to allow the hinge-protrusions 121 to be inserted into the body 131 therethrough. Here, the guide portions 133 are separated from the hinge-holes 131*a*.

Each of the guide portions 133 is formed in a curved hole or groove shape, along which the corresponding coupling protrusion 111 of the male housing 110 is easily inserted into the guide portion 133 and guided thereby when the guide portion is rotated.

The latch portion 135 protrudes downwards from the middle of the body 131. When the connection lever 130 is rotated such that the male and female housings 110, 120 are completely connected to each other, the latch portion 135 is latched to the CPA unit 140, thereby preventing rotation of the connection lever 130. The latch portion 135 is selectively disconnected from the CPA unit 140 by operation of the CPA unit.

Now, the CPA unit 140 for selectively restricting rotation of the connection lever 130 will be described in detail with reference to FIGS. 6 to 8.

Figure 6:
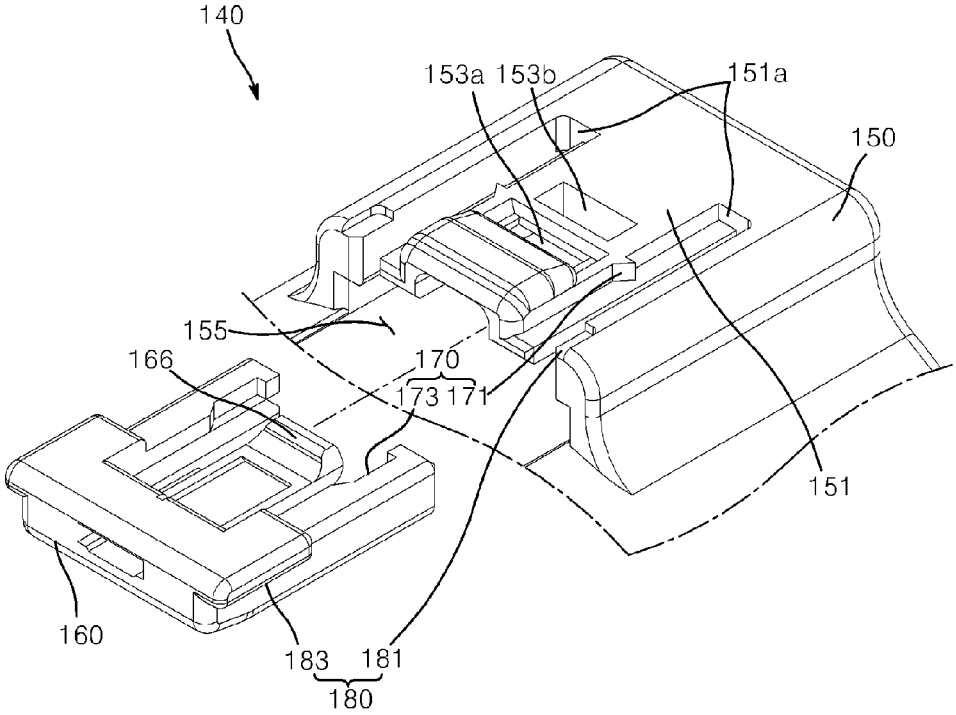
FIG. 6 is an enlarged perspective view of a connector location assurance unit according to one embodiment of the present invention.
Figure 7:
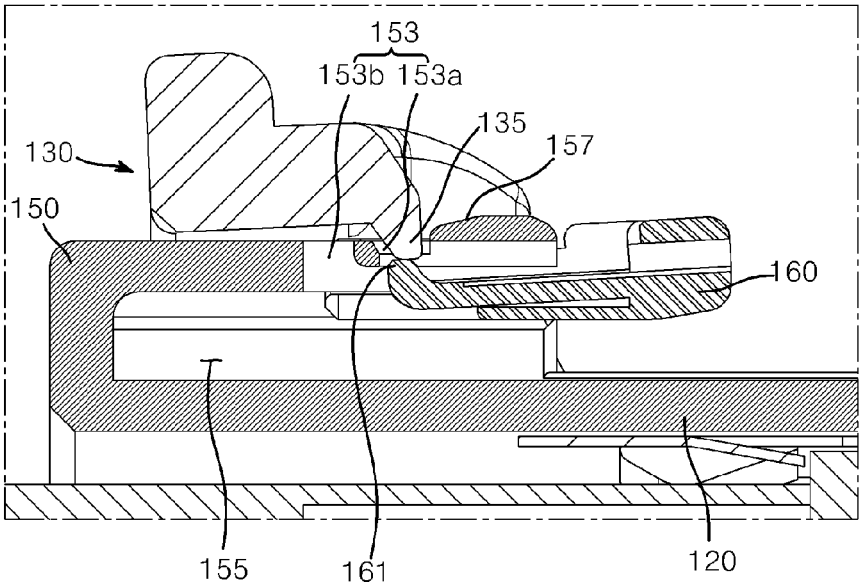
FIG. 7 is a cross-sectional view of the connection lever connected to the connector location assurance unit according to the embodiment of the present invention.

FIG. 6 is an enlarged perspective view of a connector location assurance unit according to one embodiment of the present invention, and FIG. 7 is a cross-sectional view of the connection lever connected to the connector location assurance unit according to the embodiment of the present invention.

Figure 8:
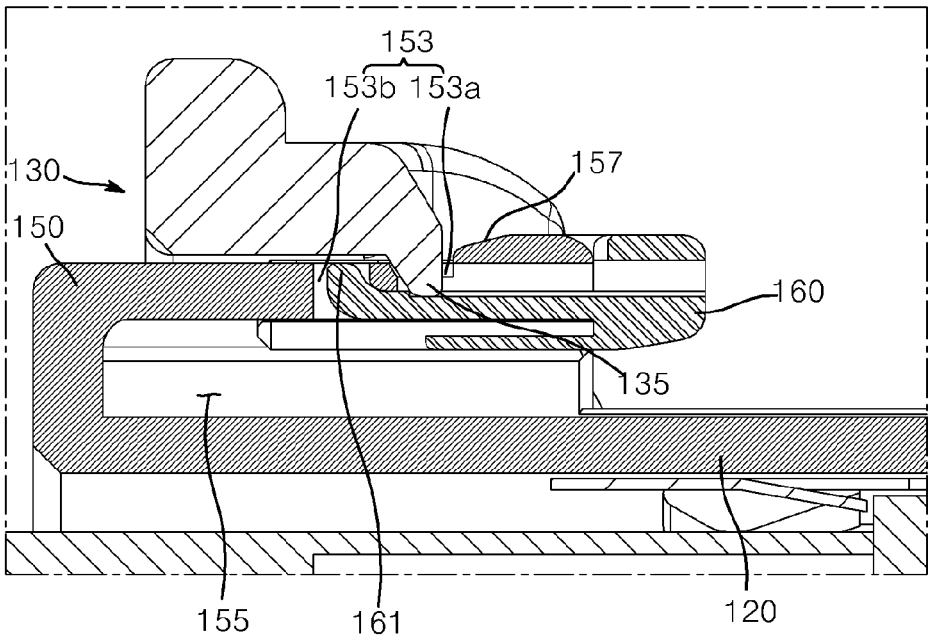
FIG. 8 is a cross-sectional view of a lever release portion of the connector location assurance unit according to the embodiment of the present invention.
Figure 9:
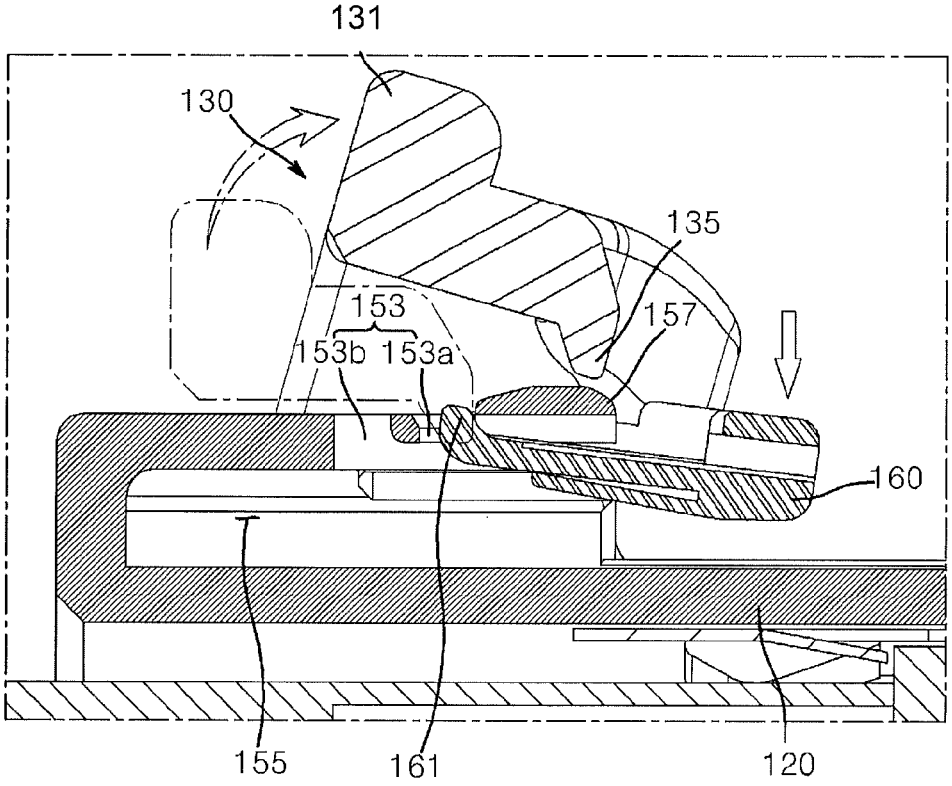
FIG. 9 is a cross-sectional view of the connection lever released by the connector location assurance unit according to one embodiment of the present invention.

FIG. 8 is a cross-sectional view of a lever release portion of the connector location assurance unit according to the embodiment of the present invention, and FIG. 9 is a cross-sectional sectional view of the connection lever released by the connector location assurance unit according to one embodiment of the present invention.

Referring to FIGS. 3 and 6 to 9, the CPA unit 140 includes a lever latch portion 150, a lever release portion 160, and a separation preventing portion 170 in order to stably interrupt rotation of the connection lever 130 and to easily release the interrupted rotation of the connection lever 130.

In the CPA unit 140, the lever latch portion 150 is provided to the female housing 120, and the lever release portion 160 is movably coupled to the lever latch portion 150.

Specifically, the latch portion 135 of the connection lever 130 is inserted into and latched to the lever latch portion 150 to come into contact with the lever release portion 160. Then, the lever release portion 160 is moved towards the inside of the lever latch portion 150, so that the lever release portion 160 is separated from the latch portion 135. As a result, a latched (interrupted) state of the latch portion 135 of the connection lever 130 to the lever release portion 160 is stably maintained.

The lever latch portion 150 includes a mounting plate 151 to which the lever release portion 160 is movably coupled, and a latch hole 153 formed in the mounting plate 151 such that the latch portion 135 is selectively latched thereby. The lever latch portion 150 has an assembly space 155 between the mounting plate 151 and the outer surface of the female housing 120 for movement and easy mounting of the lever release portion 160 on the mounting plate 151.

Further, in the lever latch portion 150, the mounting plate 151 is formed with a rounded guide section 157 which guides the latch portion 135 such that the latch portion 135 of the connection lever 130 can be easily inserted into and connected to or disconnected from the latch hole 153. The mounting plate 151 is formed with elongated holes 151*a* to which the lever release portion 160 is movably coupled.

The latch hole 153 includes a lever latch hole 153*a* to which the latch portion 135 of the connection lever is inserted into and latched, and an auxiliary latch hole 153*b* separated from the lever latch hole 153*a* and receiving the lever release portion 160. With this configuration, the latch portion 135 of the connection lever 130 and the lever release portion 160 are inserted into the lever latch hole 153*a*, and only the lever release portion 160, which moves in the lever latch hole 153*a*, is inserted into the auxiliary latch hole 153*b* and supported thereby.

The lever release portion 160 has a "E"-shape and is movably coupled to the elongated holes 151*a* of the mounting plate 151. The lever release portion 160 is formed on an upper surface thereof with a support protrusion 161 which supports the latch portion 135 inserted into the lever latch hole 153*a*. As the latch portion 135 is inserted into the lever latch hole 153*a*, with the support protrusion 161 inserted into the lever latch hole 153*a*, the support protrusion 161 comes into contact with the latch portion 135.

As such, the lever release portion 160 can be inserted into the lever latch portion 150 such that the latch portion 135 can be separated from the lever latch hole 153*a* by external pressure, with the support protrusion 161 and the latch portion 135 contacting each other, or such that the latch portion 135 can be stably maintained in a latched state, with the support protrusion 161 separated from the latch portion 135. Here, as the lever release portion 160 is moved, the support protrusion 161 separated from the lever latch hole 153*a* is moved towards the auxiliary latch hole 153*b*.

The separation preventing portion 170, which serves to prevent the lever release portion 160 from being separated from the mounting plate 151, includes a separation preventing protrusion 171 formed on an inner surface of each of the elongated holes 151*a*, and a separation preventing groove 173 formed in the lever release portion 160 such that the separation preventing protrusion 171 is inserted into and latched to the separation preventing groove 173.

The CPA unit 140 further includes an anti-pressing portion 180 which prevent the lever release portion 160, which has been moved to the auxiliary latch hole 153*a*, from being pressed by external pressure.

The anti-pressing portion 180 includes a support step 181 formed on the lever latch portion 150, and a support rib 183 protruding from the lever release portion 160 so as to be selectively supported by the supporting step 181. When the lever release portion 160 is inserted into the lever latch hole 153*a*, the support step 181 and the support rib 183 are separated from each other, and when the lever release portion 160 is inserted into the auxiliary latch portion 153*b*, the support step 181 and the support rib 183 come into contact with each other and maintain a coupled state between the lever release portion 160 and the auxiliary latch portion 153*b*.

Operation of the connector for vehicles according to the embodiment of the present invention will now be described.

When the connection lever 130 is rotated in a direction in which the male and female housings 110, 120 are connected to each other with the coupling protrusions 111 inserted into the guide portion 133, the coupling protrusions 111 are moved towards the inside of the guide portion 133, so that the female housing 120 is inserted into and connected to the male housing 110. In this state, when the connection lever 130 is further rotated in a direction for connection of the connector 100, the latch portion 135 is inserted into the lever latch hole 153*a* and comes into contact with the support protrusion 161 of the lever release portion 160. When the latch portion 135 is brought into contact with the support protrusion 161, the support protrusion 161 can be separated from the lever latch hole 153*a*.

Then, when the lever release portion 160 is moved towards the inside of the lever latch portion 150, the support protrusion 161 is separated from the lever latch hole 153*a* and then inserted into the auxiliary latch hole 153*b*. As a result, since the connection lever 130 is stably maintained in a state of being inserted into the lever latch hole 153*a*, the connection lever 130 is prevented from being separated from the lever latch hole 153*a*. That is, rotation of the connection lever 130 is completely restricted.

In addition, the supporting rib 183 is latched to the supporting step 181 as soon as the lever release portion 160 is inserted into the auxiliary latch hole 153*b*, whereby the pressing and movement of the lever release portion 160 can be restricted, thereby completely preventing malfunction of the connector.

When the male and female housings 110 and 120 are disconnected from each other, the lever release portion 160 is moved towards the outside of the lever latch portion 150. Then, the support protrusion 161 of the lever release portion 160 is separated from the auxiliary latch hole 153*b* and then inserted into the lever latch hole 153*a* to come into contact with the latch portion 135. In this state, when a distal end of the lever release portion 160 is pushed towards the female housing 120, the lever release portion 160 is rotated such that the support protrusion 161 forces the latch portion 135 to move out of the lever latch hole 153*a*.

As a result, the connection lever 130 can rotate in a direction of disconnecting the male and female housings 110, 120 from each other.

As described above, unlike the related art, the connector for vehicles according to the present invention has advantages in that disconnection between the male and female housings can be easily performed even in a narrow assembly space for connection of the male and female housings.

Although some embodiments have been disclosed herein, it should be understood that these embodiments are provided by way of illustration only, and that various modification, changes, and alterations can be made without departing from the spirit and scope of the invention. Therefore, the scope of the present invention should be limited only by the accompanying claims and equivalents thereof.

What is claimed is:

1. A connector for vehicles, comprising:

a male housing;

a female housing detachably connected to the male housing;

a connection lever rotatably mounted on the female housing so as to be latched to the male housing, the connection lever connecting or disconnecting the male housing to or from the female housing through rotation; and a connector location assurance unit provided to the female housing so as to selectively interrupt rotation of the connection lever, the connector location assurance unit comprising:

a lever latch portion provided to the male housing such that the connection lever is latched to the lever latch portion when the male housing and the female housing are connected to each other;

a lever release portion movably provided to the lever latch portion and selectively releasing the connection lever from the lever latch portion; and an anti-pressing portion for preventing the lever release portion from being pressed by external pressure, wherein the lever latch portion comprises:

a mounting plate to which the lever release portion is movably coupled;

a latch hole formed in the mounting plate such that the connection lever and the lever release portion are inserted into and latched to the latch hole; and an assembly space formed between the mounting plate and an outer surface of the female housing for movement and easy mounting of the lever release portion on the mounting plate, the latch hole comprising a lever latch hole to which the connection lever is inserted into and latched, and an auxiliary latch hole separated from the lever latch hole and receiving the lever release portion.

2. The connector for vehicles according to claim 1, wherein the connection lever comprises:

a body hingedly coupled to the female housing;

a guide portion formed on the body so as to selectively come into contact with the male housing in response to rotation of the body, and guiding the male housing to be moved such that the male housing is connected to or disconnected from the female housing; and a latch portion provided to the body so as to secure the body to the connector location assurance unit when the male housing and the female housing are connected to each other.

3. The connector for vehicles according to claim 2, wherein the male housing comprises a coupling protrusion inserted into the guide portion and the guide portion is formed in a groove shape such that the coupling protrusion is inserted into the groove and guided thereby.

4. The connector for vehicles according to claim 1, wherein the male housing comprises a coupling protrusion coupled to the connection lever and the female housing may include a sliding groove to guide the coupling protrusion to be linearly moved along the sliding groove.

5. The connector for vehicles according to claim 1, wherein the connector location assurance unit further comprises a separation preventing portion preventing separation of the lever release portion from the lever latch portion.

6. The connector for vehicles according to claim 1, wherein the lever release portion is maintained in a movable state from the lever latch portion by contact with the connection lever when the connection lever is latched to the lever latch portion.

7. The connector for vehicles according to claim 6, wherein the lever release portion is moved from the lever latch portion and separated from the connection lever, when maintained in a movable state by contact with the connection lever.

* * * * *